United States Patent [19]

Clark

[11] 4,296,523

[45] Oct. 27, 1981

[54] DUST-COLLECTION HEAD FOR A DUST COLLECTION SYSTEM

[75] Inventor: William J. Clark, Richmond, Calif.

[73] Assignee: Chevron Research Company, San Francisco, Calif.

[21] Appl. No.: 135,834

[22] Filed: Mar. 31, 1980

[51] Int. Cl.[3] ..... A47L 9/02

[52] U.S. Cl. ..... 15/415 R; 141/93

[58] Field of Search ..... 15/339, 415 R; 51/273; 144/252 R; 408/67; 141/93

[56] References Cited

U.S. PATENT DOCUMENTS

| | | | |
|---|---|---|---|
| 1,785,675 | 12/1930 | Cundiff | 15/415 X |
| 3,009,188 | 11/1961 | Martin | 15/415 X |
| 3,096,704 | 7/1963 | Russell | 141/93 X |
| 4,120,070 | 10/1978 | Severin | 15/415 R X |
| 4,184,226 | 1/1980 | Loevenich | 15/415 R |

FOREIGN PATENT DOCUMENTS

| | | | |
|---|---|---|---|
| 320479 | 2/1970 | Sweden | 15/339 |

*Primary Examiner*—Chris K. Moore

*Attorney, Agent, or Firm*—J. A. Buchanan, Jr.; R. H. Evans

[57] ABSTRACT

A dust-collection head for use in a dust-collection system. The outer end of the head has a substantially C-shaped configuration with a substantially curved face formed therein. At least two curved, parallel slots extend generally along the length of the face. A plurality of flow directors are disposed within a chamber formed in the housing of the head. And the flow directors extend inwardly from the face to form a number of flow passages within the chamber for providing a substantially even capture velocity along the face.

20 Claims, 5 Drawing Figures

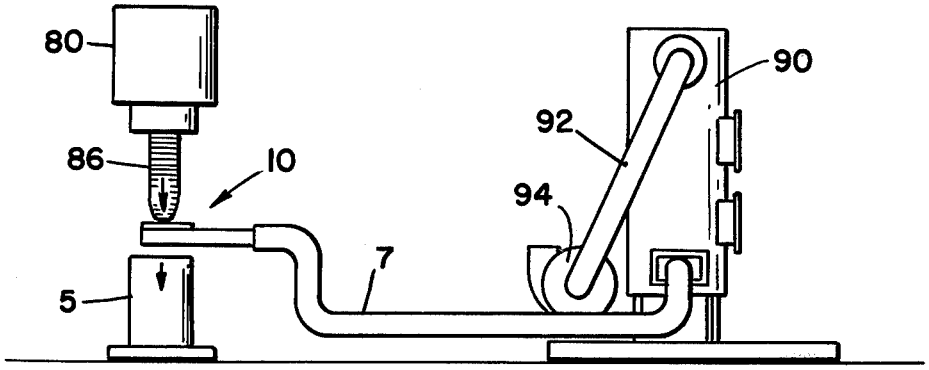
FIG_1
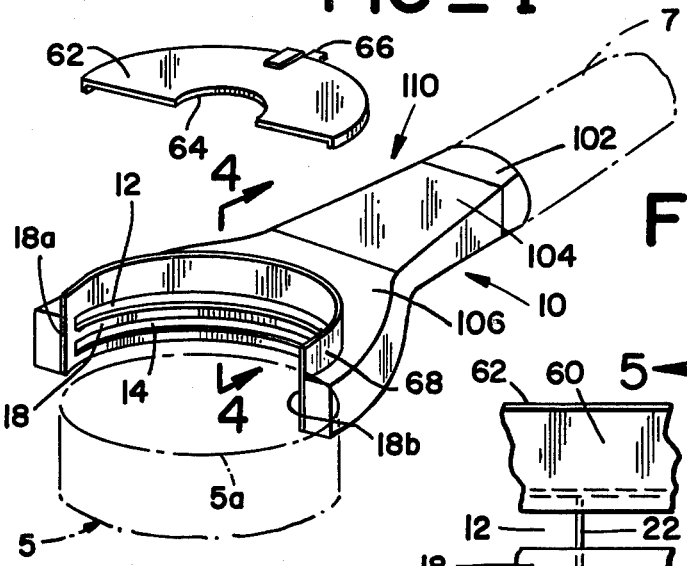
FIG_2
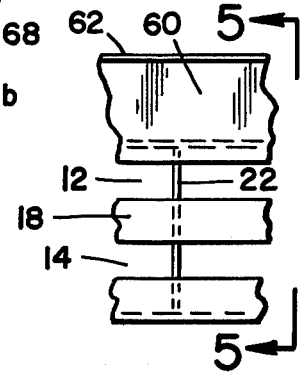
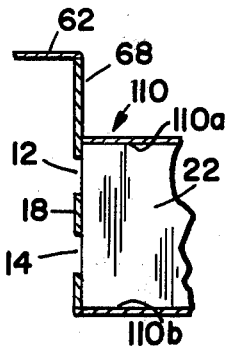
FIG_4
FIG_5
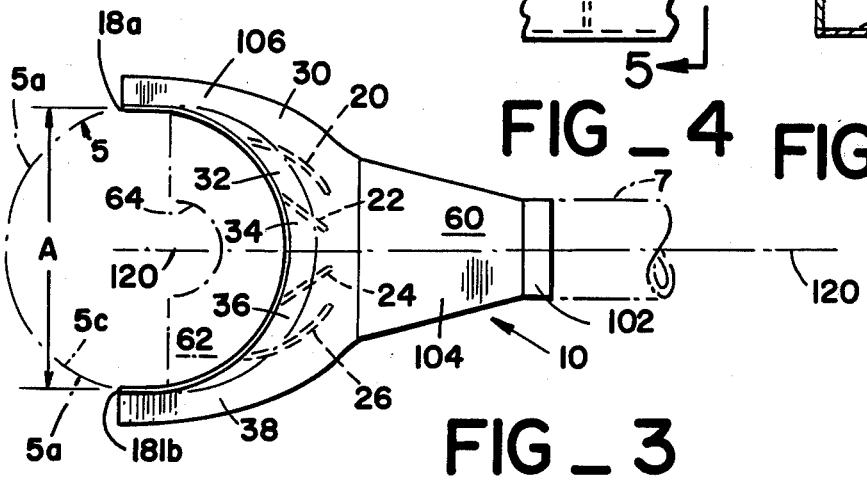
FIG_3

DUST-COLLECTION HEAD FOR A DUST COLLECTION SYSTEM

FIELD OF THE INVENTION

The present invention relates to dust-collection systems, and more specifically, to a particular configuration of a dust-collection head.

BACKGROUND OF THE INVENTION

Exposure to dust when handling certain dust-producing materials may be hazardous to personnel. For instance, when dry-dumping a nickel-containing catalyst from a reactor into an open container, toxic dusts will be produced near the area of the container. Accordingly, to protect personnel in the area, some type of dust-collection equipment needs to be provided to render the work area substantially dust-free.

The present invention is directed to dust-collection equipment for accomplishing the above-stated purpose. In particular, it is directed to a configuration for a dust-collection head that is specifically designed to control the release of very small—100 microns and smaller—and toxic dust particles produced when dumping nickel-containing catalysts into open containers. But the dust-collection head of the present invention is not to be so limited; it may be used in a variety of situations where dust-control is important.

SUMMARY OF THE INVENTION

Broadly speaking, the present invention is directed to a dust-collection head for use in a dust-collection system. The dust-collection essentially comprises a housing having a chamber formed therein wherein the housing includes an outer section, a central section, and an inner section. These three sections are juxtaposed sequentially along one dimension of the housing to extend along the central axis of the housing. The outer section of the housing has a substantially C-shaped configuration. The inner section has appropriate means for connecting ducting to the head for use in evacuating the chamber.

A substantially curved face is formed in the outer section. A plurality of parallel slots are formed in the face to extend generally along the length thereof. The maximum distance across the face is approximately equal to that across the top of the container. A plurality of vanes or flow directors are disposed with the chamber generally between the upper and lower surfaces of the housing to extend inwardly from the face. The flow directors extend toward but do not intersect the central axis of the housing, thereby forming a plurality of flow passages in the chamber.

The flow directors provide a substantially even dust-capture velocity at the face. The plurality of slots provide a higher angle of dust capture, enabling the head to capture dust particles at the outer edge portion of the container. These factors make the head very efficient in capturing substantially all dust produced at the top of the container.

BRIEF DESCRIPTION OF THE DRAWINGS

FIG. 1 is a schematic view illustrating a dust-collection system in which the dust-collection head of the present invention may be used;

FIG. 2 is a perspective view illustrating the dust-collection head in position at the top of a container;

FIG. 3 is a sectional plan view of FIG. 2;

FIG. 4 is a fragmentary view of the face of the dust-collection head along line 4—4 of FIG. 2; and FIG. 5 is a view along line 5—5 of FIG. 4.

DESCRIPTION OF THE PREFERRED EMBODIMENT

Referring to the drawings, FIG. 1 represents a vacuum-operated dust-collection system in which the dust-collection head of the present invention may be used. Particularly, FIG. 1 shows a dust-producing material being dumped from a reactor 80 by means of a dump line 86 into a container 5. The dust collection head 10 of the present invention is positioned at the top of container 5 and is connected by ducting or conduit means 7 to a wet scrubber 90. A blower 94 or other air moving means is connected by line 92 to the scrubber 90 to provide the appropriate vacuum or dust-capture velocity at head 10, the dust-capture velocity being a function of the speed at which the blower is operated.

The dust that is released as the dust-producing material flows into container 5 is drawn into head 10 from where it passes by ducting 7 to scrubber 90. The scrubber is operated, as is well known in the art, to remove the dust particles from the dust-ladden air. A cyclone, not illustrated, at the top of the scrubber removes any excess moisture from the air before the air passes through blower 94 and into the environment.

As shown in FIGS. 2 through 5, dust-collection head 10 essentially includes a housing 110 having an inner section 102, a central section 104, and an outer section 106. The three sections are juxtaposed sequentially along one dimension of housing 110; in particular, they are centered along the central or longitudinal axis 120 of housing 110. A chamber 60 is formed in housing 110 to extend from the inner section to the outer section of the housing.

The outer section 106 or outer end of the housing has a substantially C-shaped configuration. A substantially curved or arcuate face 18 is formed in the outer end of the housing. The maximum distance A across the face is approximately the same dimension as—or slightly larger than—the maximum distance across the top part 5*a* of container 5. This means that for drum-like container 5, the diameter of curvature of face 18 is approximately equal to the diameter of curvature at the top 5*a* of container 5. As shown in FIG. 3, this permits the dust-collection head to be positioned above container 5 so that at least a portion of the top part 5*a* of the container is encompassed by face 18 of the dust-collection head. At this point, it is noted that the dust-collection head is not restricted to use with a container having a circumferential top in which the diameter of curvature of the top is approximately that of the face. The head of the present invention may be used with any shape container or with a cylindrical-shaped container in which the diameter of curvature of the face is not approximately that at the top of the container. But in these instances, there would be a loss of efficiency in capturing dust particles.

A pair of curved, parallel slots 12 and 14 are formed within face 18 to extend generally along the length of the face. For structural purposes, the slots may begin at a point that is somewhat inward from the outer edge portions 18*a* and 18*b* of the face. However, it would also be possible to have the slots extending along the entire length of the face between outer edge portions 18*a* and 18*b*. The slots provide a higher angle of dust capture than that which would normally be provided with a single slot. That is to say, for a given dust-capture velocity, the dust-collection head of the present invention is more efficient in drawing in dust particles at the outer edge portion or outer circumference 5*c* of container 5. The particular number of slots formed in face 18 in the front wall of the outer end of the housing may be varied as operably desirable. But to provide a greater efficiency in capturing dust particles at the outer edge portion of the container, there must be at least two slots formed in face 18.

The housing further includes a number of flow directors or vanes 20, 22, 24, and 26 disposed within chamber 60 to extend inwardly from face 18. The flow directors are arranged in chamber 60 to converge toward central axis 120 of the housing to a point proximate to but spaced from the central section 104 of the housing. That is, the flow directors converge toward but do not intersect central axis 120, thereby forming a number of flow passages 30, 32, 34, 36, and 38 in the outer section 106 of the housing. The flow directors, as illustrated in FIG. 5, extend generally from the upper surface 110*a* to the lower surface of 110*b* of the housing. The cross-sectional areas of flow passages 30 and 38 are preferably about the same but greater than the cross-sectional areas of flow passages 32 and 36, which are approximately equal to each other. And flow passages 30, 32, 36, and 38 have a cross-sectional area greater than that of flow passage 34. In this manner, the air flow through the slots is balanced to provide a substantially even capture velocity across face 18. And in this respect, the exact number and positioning of the flow directors at face 18 may be varied to achieve the uniform capture velocity at the face for a particular size head.

The inner section 102 or inner end of housing 110 is provided with appropriate means for connecting ducting 7, which extends from the scrubber to the head. And as discussed heretofore, blower 94, which is located near the scrubber, is used to create a vacuum at face 18 at the inlet of the head to draw dust-laden air into chamber 60 through the slots. The dust-laden air then travels out of the outlet of the head or inner end of the housing via ducting 7 to scrubber 90.

The dust-collection head may further include a substantially curved projection or flange 68 extending above the top of housing 110 along the length of face 18 between its outer edges 18*a* and 18*b*. Flange 68, as known in the art, assures that the air being drawn into chamber 60 comes from a location in front of face 18 rather than from a point to the rear of face 18. This provides a greater range of dust capture, as measured outwardly from face 18, for head 10. A cover plate 62 may also be used with head 10. The cover plate will be removably mounted to the top of housing 110 at point 66 to extend past flange 68 as illustrated. Plate 62 may have a notch 64 formed therein for dump line 82.

In specific terms, a dust-collection head 10 designed to capture relatively small—100 microns and less—and heavy dust particles produced when dry-dumping a nickel-containing catalyst into 55-gallon open-top drums, will have an overall length of approximately $33\frac{1}{2}$ inches. The opening at the inner end of the housing for connection to ducting 7 will have an outside diameter of approximately $7\frac{7}{8}$ inches. Slots 12 and 14 will extend around the length of the face and be spaced about one inch inwardly of outer edge portions 18*a* and 18*b* of the face. But it is understood that the head may be constructed so that the slots extend around the entire length of the face between outer edge portions 18*a* and 18*b*. The slots will have a width of about one inch and they will be spaced about an inch apart. The height of the face will be about six inches, and the maximum dimension A across the face will be about 22 inches. The flow directors will extend inwardly from the face to a line that is spaced about $1\frac{3}{4}$ inches from the central section 104 of the head. And flange 68 will extend about three inches above the top of the housing. Operating at a dust-capture velocity of up to 3000 cubic feet per minute and with the head positioned about one inch above the top of the drum, a head of the above-described dimensions has been found to be approximately 99% efficient in collecting dust produced when dumping nickel-containing catalysts.

It is understood that the dust-collection head of the present invention is not limited to use in collecting dust when dry-dumping a catalyst. The apparatus of the invention may be employed in any number of dust-collecting applications. It is further understood that the particular number of slots and flow directors—so long as there is more than one of both—may be varied as operably appropriate.

Although the specific embodiment of the invention has been described in detail, the invention is not to be limited to only such an embodiment but rather only by the scope of the appended claims.

What is claimed is:

1. A dust-collection head for use in a vacuum-operated dust-collection system where dust-producing material is being dumped into a container, comprising:

a housing having a chamber therein;

an outer end of said housing of a substantially C-shaped configuration;

a substantially curved face formed in said outer end, said face having a plurality of slots formed therein wherein said slots are substantially parallel to each other and extend along the length of said face;

a plurality of flow directors disposed in said chamber generally from the upper surface of said housing to the lower surface thereof and extending inwardly from said face towards the central axis of said housing to form a plurality of flow passages in said chamber;

an inner end of said housing; and means at said inner end for connecting ducting to said housing for use in evacuating said chamber.

2. A dust-collection head of vacuum-operated dust-collection system for use in capturing dust particles produced when dumping a dust-producing material into a container, comprising:

a housing having an internal chamber with an inlet thereinto and an outlet therefrom;

said inlet including a curved substantially C-shaped face wherein the maximum distance across said face is approximately the same as that across the top of the container;

said face having a plurality of parallel slots formed therein wherein said slots extend substantially along the length of said face for the passage of dust particles therethrough and into said chamber, said slots providing an angle of dust capture that permits dust particles at that part of the top of the container farthest away from said face to be drawn into said chamber;

a plurality of flow directors disposed in said chamber and extending inwardly from said face toward the central axis of said housing to form a plurality of flow passages in said chamber to provide a substantially even capture velocity along said face; and means at said outlet for connecting conduit means to said housing for exhausting said chamber.

3. The dust-collection head of claim 2 wherein there are two parallel slots formed in said face.

4. The dust-collection head of claim 3 wherein there are four flow directors forming five flow passages in said chamber.

5. The dust-collection head of claim 2 further including a curved flange extending upward from the top of said housing and along the length of said face for providing a greater range of dust capture.

6. The dust-collection head of claim 5 further including a cover plate removably secured to the top of said housing to extend outwardly from at least a part of said flange.

7. A dust-collection head of a vacuum-operated dust-collection system for collecting dust particles produced when dumping a dust-producing material into a container, comprising:

a housing having a chamber formed therein, said housing having an outer section, a central section and inner section juxtaposed sequentially along one dimension of said housing;

said outer section of said housing having a substantially C-shaped configuration;

a substantially arcuate face formed in said outer section of said housing;

said face having at least two parallel slots formed therein wherein said slots extend along the curvature of said face substantially from one end of said face to the other end thereof for the passage of dust-laden air therethrough and into said chamber;

a plurality of flow directors disposed in said chamber in said outer section of said housing, said flow directors extending generally from the upper surface of said housing to the lower surface thereof and inwardly from said face toward the central axis of said housing to a position spaced from but proximate to said central section of said housing, said flow directors defining a plurality of flow passages through said outer section of said housing to provide a substantially even capture velocity along side face; and means at said inner section of said housing for connecting a conduit means to said housing for evacuating dust particles from said chamber.

8. A dust-collection head of a vacuum-operated dust-collection system for use in capturing dust particles when dumping dust-producing materials into a drum-like container, comprising:

a housing having an inner end and an outer end and defining a chamber therein;

a substantially C-shaped face forming a front wall of said outer end, the diameter of curvature across said face being approximately that at the top of the container;

said front wall having a plurality of parallel slots formed therein wherein said slots extend generally along the length of said front wall to provide an angle of dust capture sufficient to collect dust particles at the outer circumference of the container;

a plurality of flow directors in said chamber extending generally from the upper surface to the lower surface of said housing and inwardly from said front wall toward but not intersecting a central axis of said housing that generally passes through said inner end and said outer end, said flow directors forming a plurality of flow passages in said chamber to provide a substantially even dust-capture velocity along said front wall; and means at said inner end for connecting ducting to said housing for exhausting said chamber.

9. The dust-collection head of claim 8 wherein there are two parallel slots formed in said front wall.

10. The dust-collection head of claim 9 wherein there are four flow directors forming five flow passages in said chamber.

11. The dust-collection head of claim 8 further including a substantially curved flange extending upwardly from the top of said housing and along the length of said front wall to provide an increased range of dust capture.

12. The dust-collection head of claim 11 further including a cover plate removably secured to the top of said housing to project outwardly from at least a portion of said flange.

13. A dust-collection head of a vacuum-operated dust-collection system for use in capturing dust particles at the top of a drum-like container when dumping dust-producing materials therein, comprising:

a housing having a chamber therein and said housing having an outer end and an inner end;

a curved substantially C-shaped face formed at said outer end, said face having a first slot extending generally along the length thereof near the top of said housing and a second slot spaced from and parallel to said first slot extending generally along the length of said face near the bottom of said housing, the diameter of curvature of said face being approximately equal to that at the top of the container and said slots providing an angle of dust capture sufficient to collect dust particles at the outer circumference of the container;

four flow directors disposed within said chamber between the upper surface of said housing and the lower surface thereof, said flow directors being spaced from each other and extending inwardly from said face toward but not intersecting the central axis of said housing to form five five flow passages in said chamber, said flow directors providing a substantially even dust-capture velocity along said face; and means at said inner end for connecting ducting to said housing for evacuating dust particles from said chamber.

14. The dust-collection head of claim 13 further including a substantially curved flange extending upwardly from the top of said housing and along the length of said front wall to provide an increased range of dust capture.

15. The dust-collection head of claim 14 further including a cover plate removably secured to the top said housing to project outwardly from at least a portion of said flange.

16. A vacuum-operated dust-collection system for removing dust particles from dust-laden air produced when dumping dust-producing materials into a container, comprising:

a dust-collection head including (i) a housing having a chamber formed therein, said housing having an outer section, a central section and an inner section juxtaposed sequentially along one dimension of said housing, (ii) a curved substantially C-shaped face formed in said outer section, said face have a plurality of parallel slots formed therein to extend generally along the length of said face, the maximum distance across said face being approximately equal to that across the top of the container, and (iii) a plurality of flow directors disposed within said chamber to extend inwardly from said face to a location spaced from but proximate to said central section to form a plurality of flow passages in said chamber so that a substantially even dust-capture velocity is provided along said face;

one end of a conduit means connected to said inner section for evacuating the dust particles from said chamber; and means connected to the opposite end of said conduit means for creating a vacuum at said face and for removing the dust particles from the air drawn from said chamber.

17. The dust-collection system of claim 16 wherein there are two slots formed in said face.

18. The dust-collection system of claim 17 where there are four flow directors forming five flow passages in said outer section.

19. The dust-collection head of claim 18 further including a substantially curved flange extending upwardly from the top of said housing and along the length of said face to provide an increased range of dust capture.

20. The dust-collection head of claim 19 further including a cover plate removably secured to the top of said housing to project outwardly from at least a portion of said flange.

* * * * *